US007044996B2

(12) United States Patent
Taskinen et al.

(10) Patent No.: US 7,044,996 B2
(45) **Date of Patent: *May 16, 2006**

(54) METHOD FOR REDUCING BUILD-UP ON A ROASTING FURNACE GRATE

(75) Inventors: Pekka Taskinen, Pori (FI); Maija-Leena Metsärinta, Vanha-Ulvila (FI); Juha Järvi, Vanha-Ulvila (FI); Jens Nyberg, Kokkola (FI); Heikki Siirilä, Kokkola (FI)

(73) Assignee: Outokumpu Technology Oy, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 10/416,862

(22) PCT Filed: Nov. 13, 2001

(86) PCT No.: PCT/FI01/00983

§ 371 (c)(1),
(2), (4) Date: Oct. 20, 2003

(87) PCT Pub. No.: WO02/40724

PCT Pub. Date: May 23, 2002

(65) Prior Publication Data

US 2004/0060393 A1 Apr. 1, 2004

(30) Foreign Application Priority Data

Nov. 15, 2000 (FI) ..... 20002496

(51) Int. Cl.
*C22B 1/10* (2006.01)

(52) U.S. Cl. ..... 75/444; 75/387; 75/447

(58) Field of Classification Search ..... 75/754, 75/387, 444, 445, 446, 447, 448, 449, 450, 75/451

See application file for complete search history.

(56) References Cited

U.S. PATENT DOCUMENTS

| | | | | |
|---|---|---|---|---|
| 2,813,015 | A | 11/1957 | Thornhill | 75/9 |
| 2,825,628 | A | 3/1958 | Johannsen et al. | 23/177 |
| 4,409,101 | A * | 10/1983 | Salikhov et al. | 210/266 |
| 5,026,269 | A * | 6/1991 | Ruottu | 431/7 |
| 6,641,392 | B1 * | 11/2003 | Siirila | 432/58 |
| 6,814,571 | B1 * | 11/2004 | Nyberg et al. | 432/77 |

OTHER PUBLICATIONS

Abstract, Accession No. 1976-04921X, Patent No. SU 455232, Mar. 26, 1975.
Abstract, Accession No. 1992-174427, Patent No. SU 1659501, Jun. 30, 1991.
Abstract, Accession No. 1994-143331, Patent No. SU 1797681, Feb. 23, 1993.

* cited by examiner

*Primary Examiner*—Scott Kastler
(74) *Attorney, Agent, or Firm*—Morgan & Finnegan, LLP

(57) ABSTRACT

The present invention relates to method, which helps to reduce and remove the build-up forming on the grate of a fluidized-bed furnace in the roasting of fine-grained material such as concentrate. The concentrate is fed into the roaster from the wall of the furnace, and oxygen-containing gas is fed via gas nozzles under the grate in the bottom of the furnace in order to fluidize the concentrate and oxidize it during fluidization. Below the concentrate feed point, or feed grate, the oxygen content of the gas to be fed is raised compared with the oxygen content of the gas fed elsewhere.

14 Claims, 1 Drawing Sheet

METHOD FOR REDUCING BUILD-UP ON A ROASTING FURNACE GRATE

The present invention relates to a method, which helps to reduce and remove the build-up formed on the grate of a fluidized-bed furnace in the roasting of fine-grained material such as concentrate. The concentrate is fed into the furnace from the wall of the roasting furnace, and oxygen-containing gas is fed via gas nozzles under the grate in the bottom of the furnace in order to fluidize the concentrate and oxidize it during fluidization. Below the concentrate feed point, known as feed grate, the oxygen content of the gas to be fed is raised compared with gas fed elsewhere.

Roasting can be done in several different furnaces. Nowadays however, the roasting of fine-grained material usually takes place with the fluidized bed method. The material to be roasted is fed into the roasting furnace via the feed units in the wall of the furnace above the fluidized bed. On the bottom of the furnace there is a grate, via which oxygen-containing gas is fed in order to fluidize the concentrate. The oxygen-containing gas usually used is air. There are usually in the order of 100 gas nozzles/$m^2$ under the grate. As the concentrate becomes fluidized, the height of the feed bed rises to about half that of the fixed material bed.

The roasting of sulfides is described for example in the book by Rosenqvist, T.: Principles of Extractive Metallurgy, pp. 245–255, McGraw-Hill, 1974, USA. According to Rosenqvist, roasting is the oxidizing of metal sulfides, giving rise to metal oxides and sulfur dioxide. For example, zinc sulfide and pyrite oxidize as follows:

$$2ZnS+3O_2 \rightarrow 2ZnO+2SO_2 \quad (1)$$

$$2FeS_2+5\tfrac{1}{2}O_2 \rightarrow Fe_2O_3+4SO_2 \quad (2)$$

In addition, other reactions may occur such as the formation of $SO_3$, the sulfating of metals and the formation of complex oxides such as zinc ferrite ($ZnFe_2O_4$). Typical materials for roasting are copper, zinc and lead sulfides. Roasting commonly takes place at temperatures below the melting point of sulfides and oxides, generally below 900–1000° C. On the other hand, in order for the reactions to occur at a reasonable rate, the temperature must be at least of the order of 500–600° C. The book presents balance drawings, which show the conditions demanded for the formation of various roasting products. For instance, when air is used as the roasting gas, the partial pressure of $SO_2$ and O2 is about 0.2 atm. Roasting reactions are strongly exothermic, and therefore the bed needs a cooling arrangement.

The calcine is removed from the furnace partially via an overflow aperture, and is partially transported with the gases to the waste heat boiler and from there on to the cyclone and electrostatic precipitators, from where the calcine is recovered. Usually the overflow aperture is located on the opposite side of the furnace from the feed units. The removed calcine is cooled and ground finely for leaching.

For good roasting it is important to control the bed i.e. the bed has to be of stable construction and have other good fluidizing properties and the fluidizing has to be under control. Combustion should be as complete as possible, i.e. the sulfides must be oxidized completely into oxides. The calcine has also to come out of the furnace well. The particle size of the calcine is known to be affected by the chemical composition and mineralogy of the concentrate as well as by the temperature of the roasting gas.

Different ways of regulating roasting conditions have been attempted. U.S. Pat. No. 5,803,949 relates to a method of stabilizing the fluidized bed in the roasting of metal sulfides, where stabilizing occurs by controlling the particle size of the feed. In U.S. Pat. No. 3,957,484 stabilization occurs by feeding the concentrate as a slurry. To a roasting furnace according to U.S. Pat. No. 6,110,440 gas is fed through a header pipe into the middle part of the grate and the gas is distributed evenly to the whole cross section of the furnace by means of several branch pipes. The branch pipes are equipped with different-sized of nozzles so that the diameter of the nozzles farthest from the header pipe is bigger than that of the nozzles locating nearer the header pipe. The diameter of the nozzles varies between 1.5–20 mm. Gas can be fed into the fluidized bed via several gas distributing tube systems and then for example the one tube system is for gases containing oxygen and the other for gases containing organic material.

In a zinc roaster, zinc sulfide concentrates, which are pure ore impure may be handled depending on the situation. Concentrates are no longer anywhere near pure zinc blende, sphalerite, but may contain a considerable amount of iron. Iron is either dissolved in the sphalerite lattice or in the form of pyrite or pyrrhotite. In addition, concentrates often contain sulfidic lead and/or copper. The chemical composition and mineralogy of the concentrates vary enormously. In this way the amount of oxygen required for oxidation of the concentrates also varies, as does the amount of heat produced on combustion. In the technique currently in use the roaster concentrate feed is regulated according to the temperature of the bed using fuzzy logic for example. Thus there is a danger that the oxygen pressure in the fluidizing gas drops too low i.e. that the amount of oxygen is insufficient to roast the concentrate. At the same time the back pressure of the bed may fall too low.

It is known from balance calculations and balance diagrams in the literature that copper and iron together form oxysulfides, which are molten at roasting temperatures and even lower temperatures too. Similarly, zinc and lead as well as iron and lead both form sulfides molten at low temperatures. This kind of sulfide appearance is possible and the likelihood grows if the amount of oxygen in the bed is smaller than that normally required to oxidize the concentrate.

During fluidized bed roasting agglomeration of the product normally occurs, i.e. the calcine is clearly coarser than the concentrate feed. The above-mentioned formation of molten sulfides nevertheless increases agglomeration to a disturbing degree, in that the agglomerates with their sulfide nuclei remain moving around the grate. Agglomerates cause build-ups on the grate and, over the course of time, block the gas nozzles under the grate. It has been noticed in zinc roasters that build-ups containing impure components are formed in the furnace particularly in the part of the grate under the concentrate feed units.

It has been noted in laboratory research that some concentrates, for example very fine-grained concentrates rich in pyrite, oxidize very quickly when they subject to roasting conditions. It has been noted on the other hand that when calculated according to chemical and mineralogical composition, this kind of concentrates has a markedly higher oxygen requirement than a pure sphalerite concentrate. When a great deal of impure, highly reactive concentrate mentioned before, is fed to the roaster, an oxygen deficit is caused in the immediate vicinity of the feed unit preventing the oxidation of the concentrates to oxides, the actual purpose of roasting. As a result of the oxygen deficiency, at low temperatures a molten sulfidic material is formed, which agglomerates easily. The larger agglomerates sink to the grate, remaining to move around and combine to form a layer of build-up, which blocks the gas nozzles and in that way further increases the oxygen deficiency.

The purpose of the method developed now is to reduce and remove the build-up forming on the fluidized bed grate in the roasting of fine-grained material by increasing the feed of oxygen-containing gas, particularly in that part of the roasting furnace into which the material is fed. The invention is appropriate especially for zinc concentrates. The essential features of the invention will be made apparent in the attached claims.

Figure 1:
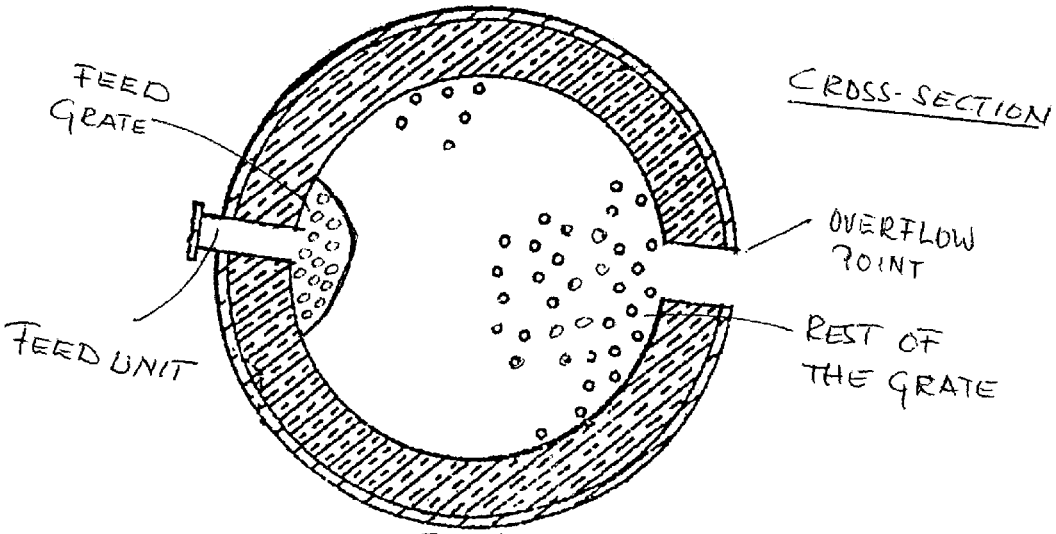
FIGS. 1 and 2 represent feed grate arrangements for performing the method of the instant invention.
Figure 2:
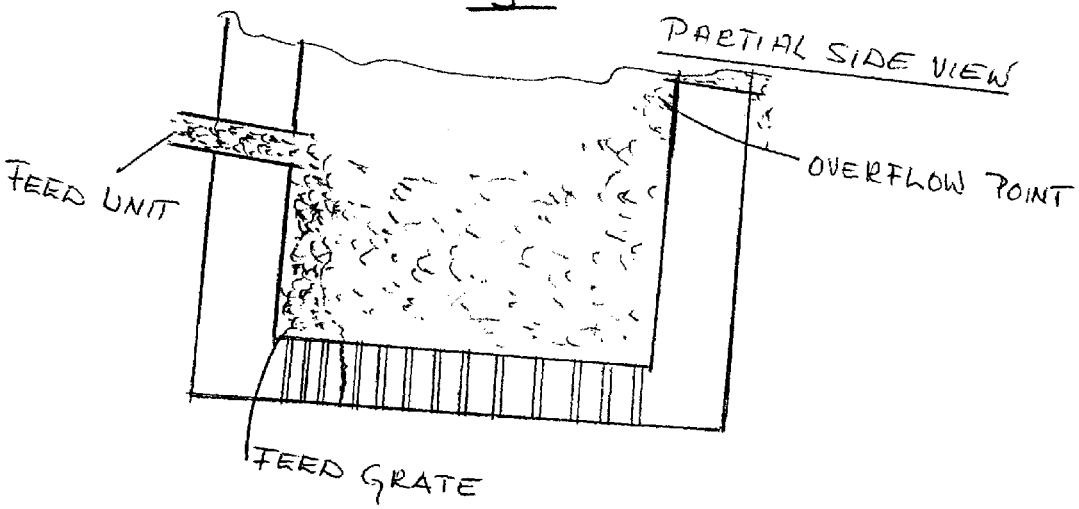

The build-up forming on the grate at the point of the roaster feed units is reduced according to the invention by changing the conventional grate construction, whereby the gas feed to the whole cross-section of the grate occurs uniformly and the same amount of gas is fed to every part of the grate. Using the method now developed, the oxygen-containing gas feed to that part of the grate located below the feed units, known as the feed grate, is increased compared with the gas feed to the rest of the grate. The gas feed increase takes place for example by increasing the number of the gas nozzles to the feed grate or using bigger gas nozzles (larger cross-section) than in the rest of the grate. The number of gas nozzles at the feed grate is at least 5%, preferably 10–15% bigger the number of the gas nozzles in the rest of the grate. If the amount of oxygen of the roasting gas is increased by increasing the cross-section area of the gas nozzles at the feed grate, the cross-section area of the nozzles in the feed grate is at least 5% preferably 10–15% larger than the cross-section area of the nozzles in the rest of the grate. More oxygen-rich gas can be fed via some of the nozzles than the gas fed to the rest of the grate. The feed grate constitutes at least 5% of the total roasting furnace grate, preferably 10–15%.

When the oxygen-containing gas feed is increased in the feed grate area of the roasting furnace the formation of build-ups is prevented by two ways, i.e. firstly by removing the local oxygen deficiency and secondly by increasing the gas feed which means that the fluidizing rate is increased in that area. Removal of oxygen deficiency prevents agglomerate formation and the increased fluidizing rate keeps particles bigger than normal in the bed with without sinking to the grate. If the oxygen deficiency is removed by increasing the oxygen content of the gas locally it does not necessarily increase the amount of the gas feed and so it does not improve the fluidizing rate but rather it only causes the concentrate particles to oxidize therefore preventing formation of molten material.

The invention is described further in the following example:

EXAMPLE 1

A concentrate with a sphalerite composition was compared to a zinc concentrate containing pyrite. Calculating the oxygen requirement of the concentrates showed that the oxygen requirement of the sphalerite concentrate in roasting is 338 $Nm^3/t$ and for the pyrite-containing concentrate 378 $Nm^3/t$, in other words the oxygen requirement of the pyrite-containing concentrate is over 10% greater than that of the sphalerite concentrate. The mineral contents of the concentrates are shown in Table 1.

TABLE 1

| Mineral | Sphalerite concentrate w-% | Pyrite-containing concentrate w-% |
|---|---|---|
| $CuFeS_2$ | 0.09 | 1.73 |
| FeS | 2.54 | 2.85 |
| $FeS_2$ | 0.35 | 21.63 |
| ZnS | 91.66 | 68.11 |
| PbS | 1 | 3.11 |
| CdS | 0.24 | 0.18 |
| $SiO_2$ | 0.94 | 0.43 |
| $CaSO_4$ | 0.83 | 0.1 |
| $CaCO_3$ | 1.05 | 0.5 |
| others | 1.3 | 1.36 |

The invention claimed is:

1. A method for reducing and removing a build-up forming on a floor grate of a fluidized bed furnace in roasting of a fine-grained material, the method comprising:

feeding the material into a roaster from a wall of the furnace at a feed point;

feeding oxygen-containing gas via gas nozzles situated under the floor grate in the bottom of the furnace in order to fluidize and oxidize the material;

increasing an oxygen content of the gas fed through a feed grate portion of the floor grate, which is near the feed point of the material, compared to an oxygen content of gas fed to a remainder of the floor grate; and providing a plurality of gas nozzles in the floor grate in a concentration, per unit area, such that the concentration of nozzles in the feed grate is between 5% and 20% greater than a concentration of gas nozzles in the remainder of the floor grate, all of the gas nozzles being connected to a single gas feed tube.

2. The method according to claim 1, wherein the feed grate forms at least 5% of the total cross-sectional area of the floor grate.

3. The method according to claim 1, wherein the feed grate forms 10–15% of the total cross sectional area of the floor grate.

4. The method according to claim 1, wherein the concentration of gas nozzles at the feed grate is 10–20% greater than the concentration of gas nozzles in the remainder of the floor grate.

5. The method for reducing and removing a build-up forming on a floor grate of a fluidized bed furnace in roasting of a fine-grained material, the method comprising:

feeding the material into a roaster from a wall of the furnace at a feed point;

feeding oxygen-containing gas via a single gas feed tube and gas nozzles situated under the floor grate in the bottom of the furnace in order to fluidize and oxidize the material;

increasing an oxygen content of the gas fed through a feed grate portion of the floor grate, which is near the feed point of the material, compared to an oxygen content of gas fed to a remainder of the floor grate; and providing a plurality of gas nozzles in the floor grate, such that a concentration, per unit area, of cross sectional area of the gas nozzles in the feed grate is between 5% and 20% greater than a concentration of cross sectional area of gas nozzles in the remainder of the grate, all of the gas nozzles being connected to a single feed tube.

6. The method according to claim 1, wherein a fluidizing gas is fed into the furnace via the feed grate having an oxygen content higher than an oxygen content of the fluidizing gas fed into the remainder of the floor grate.

7. The method according to claim 6, wherein the material to be roasted is zinc concentrate.

8. The method according to claim 1, wherein the material to be roasted is iron containing sulfide concentrate.

9. The method according to claim 5, wherein the concentration, per unit area, of cross sectional area of the gas nozzles in the feed grate is 10–20% greater than the concentration of cross sectional area of the gas nozzles in the remainder of the floor grate.

10. The method according to claim 5, wherein the feed grate forms at least 5% of the total cross-sectional area of the floor grate.

11. The method according to claim 5, wherein the feed grate forms 10–15% of the total cross sectional area of the floor grate.

12. The method according to claim 5, wherein a fluidizing gas is fed into the furnace via the feed grate having an oxygen content higher than an oxygen content of the fluidizing gas fed into the remainder of the floor grate.

13. The method according to claim 5, wherein the material to be roasted is zinc concentrate.

14. The method according to claim 5, wherein the material to be roasted is iron containing sulfide concentrate.

* * * * *